United States Patent [19]

Seaburg et al.

[11] Patent Number: 4,522,005

[45] Date of Patent: Jun. 11, 1985

[54] CLIP CONNECTOR FOR BUILDING PANELS HAVING INTERLOCKED SECTIONS

[75] Inventors: Paul A. Seaburg; Warren E. Mueller, both of Middletown, Ohio

[73] Assignee: Armco Inc., Middletown, Ohio

[21] Appl. No.: 545,358

[22] Filed: Oct. 25, 1983

[51] Int. Cl.[3] ..... E04D 1/34

[52] U.S. Cl. ..... 52/544; 52/520; 52/528; 52/547; 52/713

[58] Field of Search ..... 52/478, 520, 528, 544, 52/547, 713, 573, 489, 506, 542

[56] References Cited

U.S. PATENT DOCUMENTS

| | | | |
|---|---|---|---|
| 1,816,556 | 7/1931 | White | 52/542 |
| 2,015,129 | 9/1935 | Voigt et al. | 52/489 X |
| 3,225,504 | 12/1965 | Gregoire | 52/520 X |
| 3,390,856 | 7/1968 | Van Buren, Jr. | 52/489 X |
| 3,982,373 | 9/1976 | Wilson et al. | 52/588 |
| 3,998,019 | 12/1976 | Reinwall, Jr. | 52/478 |
| 4,102,105 | 7/1978 | Taylor et al. | 52/520 |
| 4,120,123 | 10/1978 | Knudson | 52/86 |
| 4,177,615 | 12/1979 | Anderson | 52/478 |
| 4,213,282 | 7/1980 | Heckelsberg | 52/404 |
| 4,269,012 | 5/1981 | Mattingly et al. | 52/394 |
| 4,296,581 | 10/1981 | Heckelsberg | 52/520 |
| 4,348,846 | 9/1982 | Bellem | 52/410 |

FOREIGN PATENT DOCUMENTS

| | | | |
|---|---|---|---|
| 2400598 | 10/1976 | France | 7/2 |

*Primary Examiner*—Alfred C. Perham
*Attorney, Agent, or Firm*—Frost & Jacobs

[57] ABSTRACT

A clip connector for anchoring rigid interlocked panels to spaced supporting members. The clip includes a washer member slidingly engaged on a base formed from the bottom of the upstanding clip web. The washer member is provided with an aperture extending therethrough exteriorly of the base. A fastener extends through the aperture and secures the washer member, in restrained but slidable engagement with the base, to a supporting member. Centering means may be provided on the clip web to position the washer member with respect to the base. Stop means may be provided at each edge of the base for limiting the movement of the base with respect to the washer member.

13 Claims, 10 Drawing Figures

CLIP CONNECTOR FOR BUILDING PANELS HAVING INTERLOCKED SECTIONS

TECHNICAL FIELD

The present invention relates to building structures, and more particularly to connectors for joining building panels to framing members, such as roofing, wall and floor panels to purlins, joists or girts.

BACKGROUND ART

A typical metal building structure, such as a roof structure or a wall structure, includes a plurality of spaced supporting members, such as purlins, joists or girts, and a series of relatively stiff and rigid interlocked roof or wall panels closing the space between the supporting members. The panels are almost always lapped and sealed, depending upon the length of the roof or wall and the panel length. The prior art fastens lapped joints directly to structural supporting members with hidden clip connectors. A typical prior art clip connector utilizes a base flange having an elongated slot which permits the clip to move relative to the supporting member and with the expansion or contraction of the panels. However, the movement of the clip is limited by the length of the slot. Furthermore, the slot weakens the clip base. Accordingly, this type of clip connector has been found to be deficient in resisting harmful effects of thermal contraction and expansion in addition to certain weaknesses in pull-out strength.

SUMMARY OF THE INVENTION

In contrast to the various prior art devices and methods of attachment for anchoring rigid interlocked panels to spaced supporting members, the present invention utilizes a clip connector having a body portion which includes a base formed from the bottom of an upstanding planar element and being substantially perpendicular thereto and extending therefrom to form toe and heel portions, respectively. A washer member slidably engages on the base and projects outwardly therefrom. The washer member is provided with a first portion overlying the toe and with a second portion associated with the heel and underlying the base. An aperture extends through the first and second portions of the washer member exteriorly of the base. A fastener extends through the aperture and secures the washer member to a supporting member, forcing the upper and lower members thereof into restrained but slidable engagement with the base. In a preferred embodiment centering means may be provided on the upstanding planar element of the body portion for positioning the washer member with respect to the base. In still a further embodiment stop means may be provided at each edge of the base for limiting the movement of the base with respect to the washer member. The clip connector of the present invention precludes the base of the clip connector from becoming disengaged from the washer member as a result of extreme panel movement caused by thermal gradients or wind or snow loads. The maximum movement of the clip connector is not limited by the length of a slot, but allows unlimited movement, with the only constraint being the length of the base, or the length of the base between the stop means, and the width of the washer member.

The structure of the clip connector of the present invention prevents clip pull-out during wind uplift and provides substantially improved pull-out strength over prior art type clips.

DETAILED DESCRIPTION

While the clip connector of the present invention will be described in terms of its use with the interconnection of roof panels in securement of roof panels to a supporting structure, it will be understood that this description is exemplary only and that the clip connector may be used for connecting any covering members to framing members, including roofing, wall and floor panels to supporting members, such as purlins, joists or girts.

Figure 1:
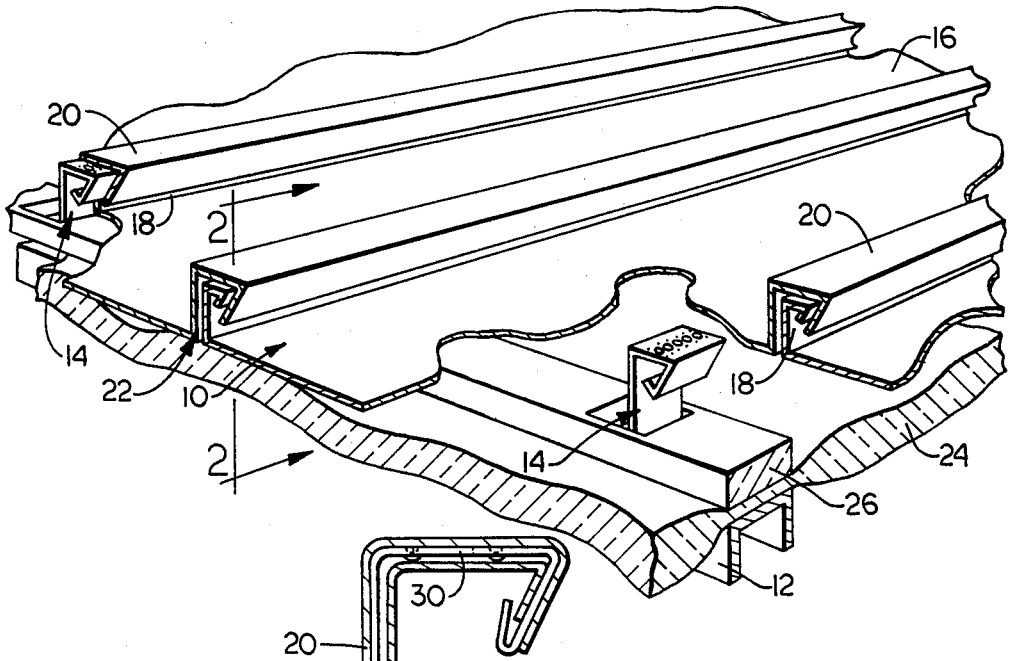
FIG. 1 is a perspective view of an exemplary roof structure showing interlocked panels with clip connectors of the present invention anchoring them to a supporting member.

Referring now to the drawings, and in particular to FIG. 1, it will be seen that a typical building structure incorporating the present invention may include a series of relatively stiff and rigid interlocked exemplary panels 10 of self-supporting capacity affixed to and closing the space between spaced supporting members, such as, for example, the purlins 12, and clip connectors 14, which are of a relatively shorter length than the coupled panels 10 and anchor the coupled panels 10 to the purlins 12.

Each of the panels 10 may be provided with a central web surface 16 and a pair of side walls forming male and female members 18 and 20, respectively, projecting outwardly from opposing edges of the web 16 to form inverted ribs along the abutting edges of the panels 10 adapted to interlock to form rib joints 22.

Suitable insulation 24, such as blanket or roll insulation, may be installed over the supporting members or purlins 12, and substantially rectangular insulation 26 may be laid on the purlins 12 over the blanket or roll insulation 24. Alternatively, suitable rigid board insulation may be installed over the supporting members 12 in lieu of the insulation 24, 26.

In its simplest form, the clip connector 14 of the present invention includes a body having an upstanding element 28, an upper portion 30 which mates with a rib joint 22 of interlocking panels 10, and a base 34 formed from the bottom planar element 28 and being substantially perpendicular thereto and extending therefrom to form toe and heel portions 34*a* and 34*b*, respectively. A washer member 36 is slidably engaged on the base 34 and projects outwardly therefrom. The washer 36 includes a first portion 36*a* overlying the toe 34*a* of the base 34 and a second portion 36*b* associated with the heel 34*b* of the base 34 and underlying the base 34. An aperture 38 extends through the first and second portion 36*a* and 36*b* respectively, exteriorly of the base 34. A suitable through fastener 42, such as a self-drilling screw, extends through the aperture 38 in the first and second portions 36*a* and 36*b*, respectively, of the washer member 36 securing the washer member 36 to a supporting member, such as the purlin 12, forcing the first and second portions 36*a* and 36*b*, respectively, of the washer member into restrained but slidable engagement with the toe portion 34*a* of the base 34, and the base 34 is free to move the entire length thereof.

The upper portion 30 of the clip connector 14 may be horizontal and may include a flange hook portion 32 depending downwardly therefrom, or it may be other than horizontal with or without a depending hook flange portion 32, as desired, to mate with a joint 22 of a variety of prior art interlocking panels 10.

It will be seen that for purposes of strength, the base 34 of the clip body could be a one-piece extrusion or formed to join with the upstanding portion 28, as desired. Additionally, the upstanding planar element 28 may be provided with suitable stiffening ribs 60 to add strength thereto to prevent twisting or distortion of the clip connector 14 during uplift or sliding.

In practice it has been found that best results are obtained when the first and second portions 36*a* and 36*b*, respectively, of the washer member 36 are integral. Additionally, the underside of the aperture 38 may be provided with a shoulder portion 40 therearound which, as will be more fully explained hereinafter, prevents the upper surface of the second portion 36*b* from being squeezed so as to clamp the toe 34*a* of the base 34 between the first and second portion 36*a* and 36*b*, respectively, when the through fastener 42 is tightened excessively. The same result may, of course, be achieved if the shoulder 40 is positioned on the surface of the second portion 36*b*.

Figure 2:
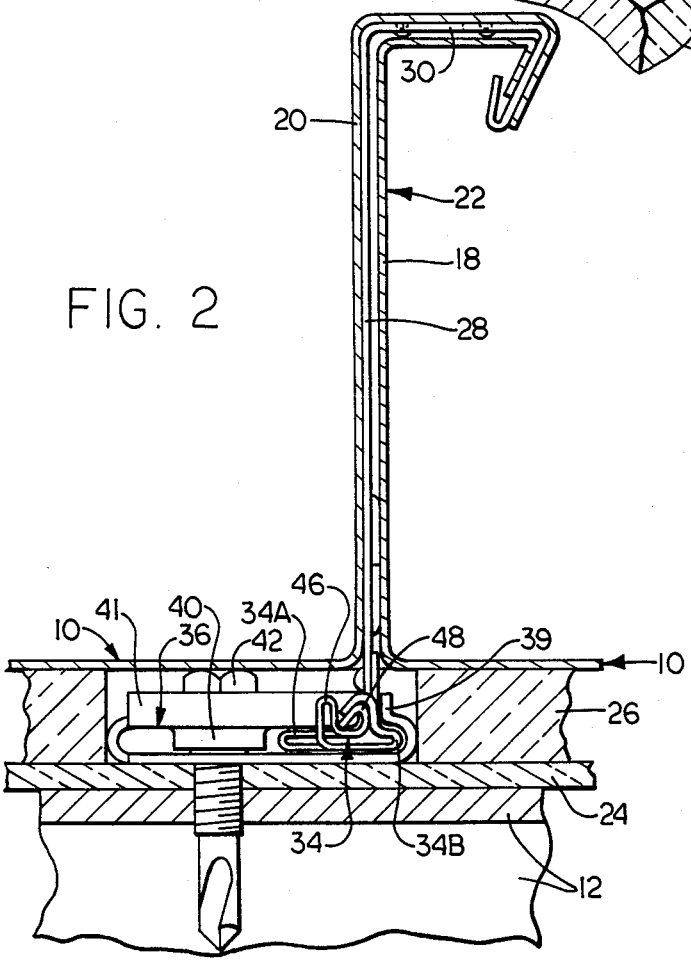
FIG. 2 is a partial cross sectional view taken through a typical rib joint showing the clip connector of the present invention.
Figure 4:
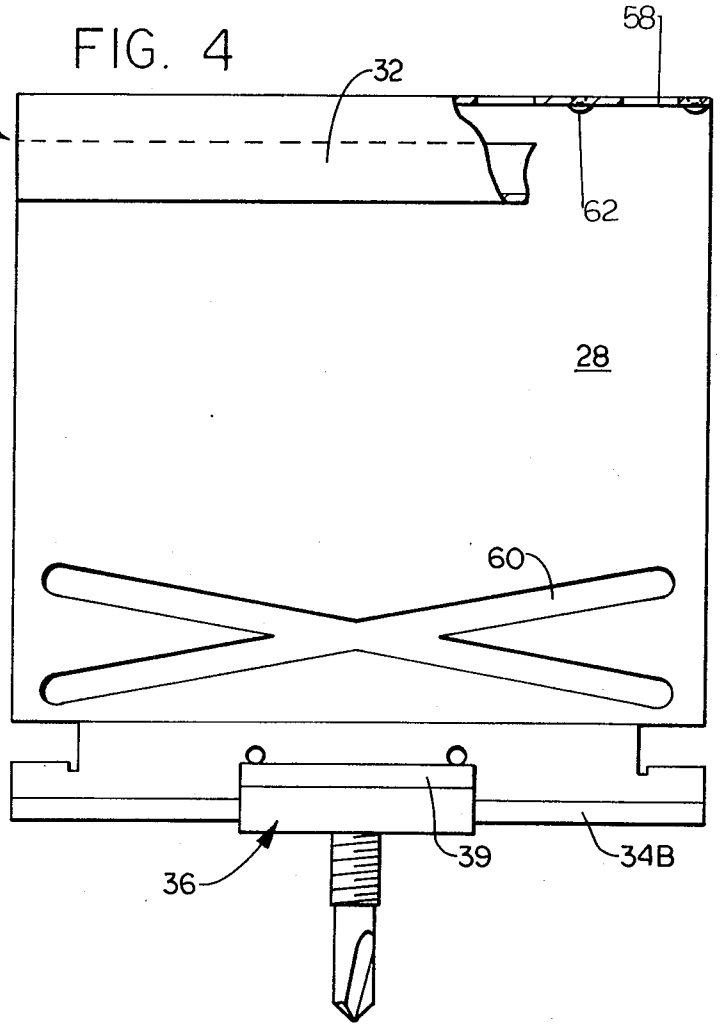
FIG. 4 is a side elevational view of the clip connector as seen from the right in FIG. 2.
Figure 3:
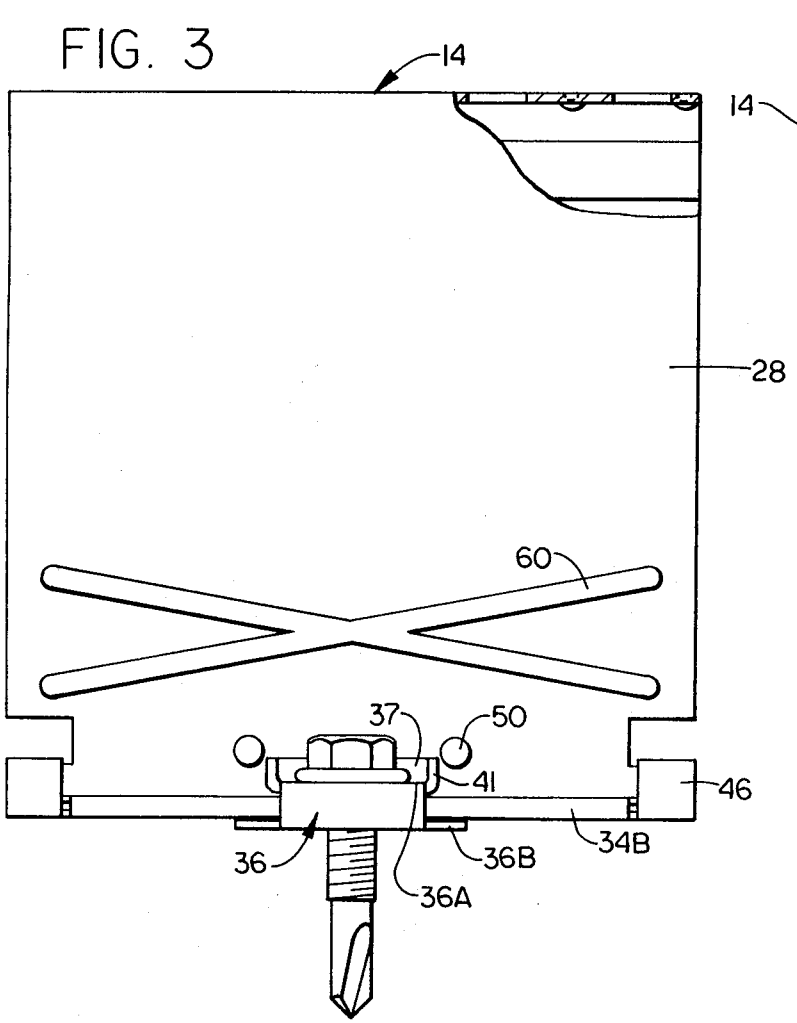
FIG. 3 is a side elevational view of the clip connector as seen from the left in FIG. 2.
Figure 5:
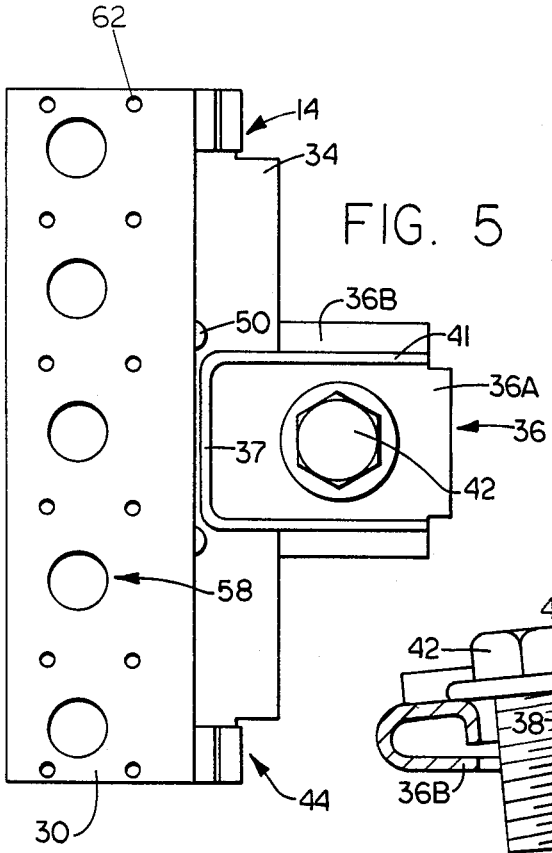
FIG. 5 is a plan view of the clip connector.
Figure 6:
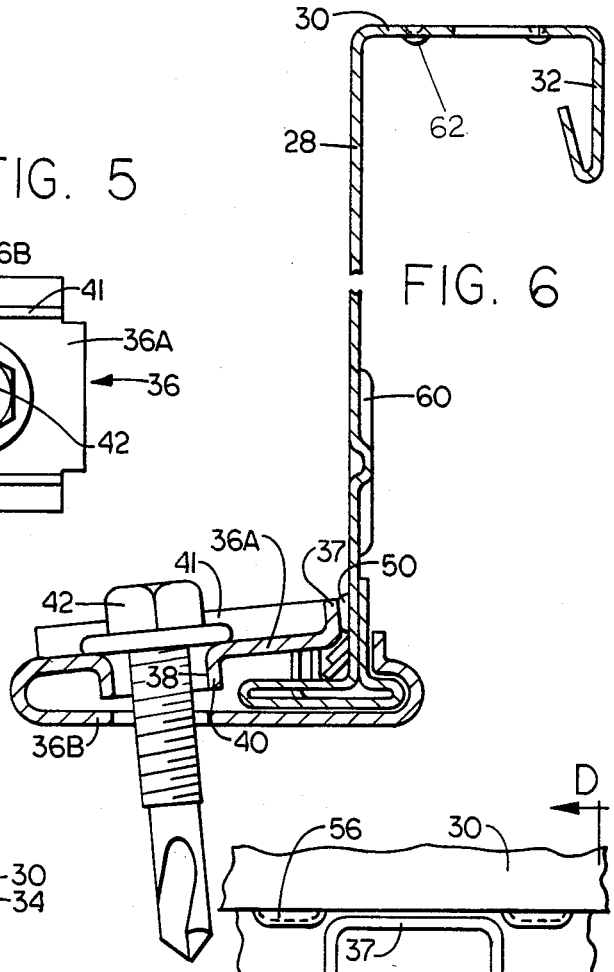
FIG. 6 is a cross-sectional view through a clip connector of the present invention prior to installation.

It may be desired to limit the movement of the base 34 with respect to the washer member 36. This may be achieved by utilizing stop means 44 at each edge of the base 34. While the stop means 44 may comprise a suitable dimple in the upstanding planar element 28, preferably the stop means 44 is formed by an end portion 46 of each end of the base 34, which is turned upwardly substantially 90°, and by a lower edge portion 48 of the upstanding planar member 28 being turned downwardly to engage therewith. As best seen in FIG. 2, the downwardly turned lower edge portion 48 is approximately at a 45° angle with respect to the base 34.

It will, of course, be seen that the maximum movement of the base 34 with respect to the washer member 36 is determined by the length of the base 34, or if stop means 44 are used, by the length of the base 34 between the stop means 44, and the width of the washer member 36.

If it is desired to increase the movement of the base 34, it is only necessary to increase the length of the base 34 and/or to decrease the width of the washer member 36. However, it has been determined that in general the desired maximum movement is approximately two inches. This movement may be achieved if the length of the base is approximately three inches and the width of the washer member is approximately one inch.

In practice, it is found that the ends of the first and second portions 36*a* and 36*b*, respectively, of the washer member 36 which are contiguous with the upstanding planar element 28, are preferably provided with upstanding stiffening flanges 37 and 39, respectively. Additionally, an upstanding flange 41, which may be a separate piece or integral with the upstanding flange 37, may be provided on the side edges of the first portion 36*a*. The upstanding portions 37, 39 and 41 all assist in preventing the base 34 from pulling out of the washer member 36 and in precluding the washer member 36 from bending and unravelling during extreme panel movements caused by thermal gradients or wind or snow loads.

Figure 7A:
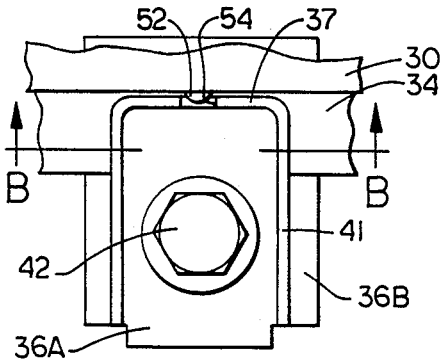
FIG. 7A is a partial plan view of the clip connector showing the washer member and a variation of the centering means.
Figure 7C:
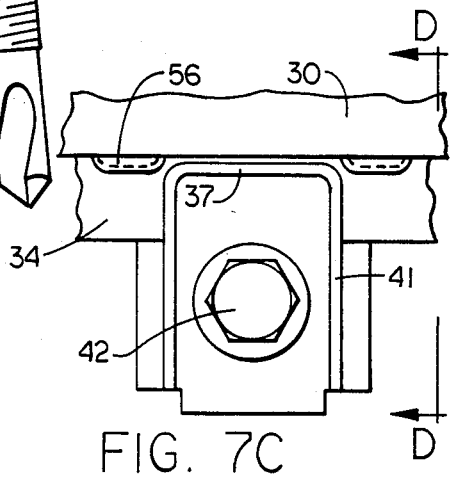
FIG. 7C is a view similar to FIG. 7A showing a further variation of the centering means.
Figure 7B:
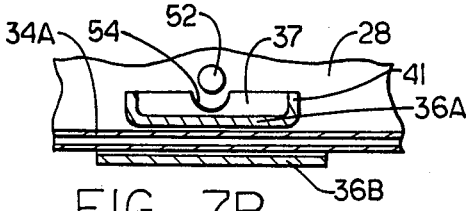
FIG. 7B is a cross-sectional view taken on the line B—B of FIG. 7A.
Figure 7D:
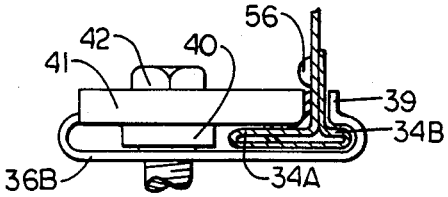
FIG. 7D is a partial cross-sectional view taken on the line D—D of FIG. 7C.

Centering means, such as spaced, substantially spherical, dimples 50 on the upstanding planar element 28 on either side of the washer member 36, may be utilized, as desired, to properly center the washer member 36 with respect to the base 34 during installation. It will, of course, be understood that the centering means may comprise any variety of structures, including a single dimple 52 on the upstanding planar element 28 and an associated notch 54 in the stiffening flange 37 on the end of the first portion 36*a* of the washer member 36, as seen in FIGS. 7A and 7B, or spaced, elongated dimples or darts 56 on the upstanding planar element 28 on either side of the first portion 36*a* of the washer member 36, as seen in FIGS. 7C and 7D. Additionally, as shown in FIGS. 2, 7B and 7D, the dimples 50, 52 and 56 may be so located that when the through fastener 42 is tightened so as to secure the washer member 36 to the purlin 12 and the first portion 36*a* of the washer member 36 is pulled downwardly toward the toe 34*a* of the base 34, the first portion 36*a* of the washer member 36 is no longer restrained by the centering means. It will, of course, be understood that the washer member 36 acts like a spring, with the first portion 36*a* thereof being at a slight angle relative to the second portion 36*b* so as to allow engagement with the centering means 52, 56 until disengaged when the through fastener 42 is installed.

As can be seen, the clip connector 14 of the present invention provides a significant advance in the art of clip connectors because the base 34 thereof is allowed unlimited movement to slide within the washer member 36. In contrast, prior art clip connectors, whether they include a washer or not, include a hole or slot in the base of the clip. If the opening is a round hole, no movement is provided for thermal expansion. If the hole is a slot, the maximum movement is the length of the slot. Furthermore, a slot weakens the clip base. The clip connector 14 of the present invention removes the opening from the base of the clip connector.

Finally, the clip connector 14 of the present invention may be provided with spaced apertures 58 and downwardly dimpled protrusions 62 on the upper portion 30 of the upstanding planar portion 28 to facilitate the flow of the sealant, either a bead of sealant factory-applied to the underside of the female member 20 or field-applied on the upper portion 30 of the clip connector 14, from the underside of the female member 20, through the upper portion 30 of the clip connector 14, to the outer surface of the male member 18.

While the invention has been described in connection with specific embodiments thereof, it is evident that the many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A clip connector for anchoring rigid interlocked panels to spaced supporting members comprising:

(a) a body portion having an upstanding planar element, an upper portion which mates with the interlocked panels, and a base formed from the bottom of said planar element and being substantially perpendicular thereto and extending therefrom to form toe and heel portions, respectively;

(b) a washer member slidably engaged on said base and projecting outwardly therefrom, said washer member having a first portion overlying said toe and a second portion associated with said heel and underlying said base, and an aperture extending through said first and second portions exteriorly of said base; and (c) a fastener extending through said aperture for securing said washer member to a supporting member, said fastener forcing said first and second portions of said washer member into restrained but slidable engagement with said base; whereby during movement of said panels, said panels are allowed to move with respect to said supporting members as said base moves with respect to said washer member.

2. The clip connector according to claim 1, including centering means on said upstanding planar element for positioning said washer member with respect to said base.

3. The clip connector according to claim 1, including stop means at each edge of said base for limiting the movement of said base with respect to said washer member.

4. The clip connector according to claim 1, wherein the underside of said aperture is provided with a shoulder portion therearound which prevents said second portion from being squeezed so as to clamp the toe of said base between said first and second portions when said fastener is excessively tight.

5. The clip connector according to claim 1, wherein an upstanding flange is provided on the edge of said first portion to prevent said washer member from bending and unravelling during uplift and to thus preclude the separation of said base from said washer member.

6. The clip connector according to claim 1, wherein said base comprises a member folded over upon itself and flattened into said toe and heel portions.

7. The clip connector according to claim 1, wherein the heel of said washer member includes an upstanding portion which assists in preventing the separation of said base from said washer member during uplift of said body portion.

8. The clip connector according to claim 3, wherein each said stop means is formed by an end portion of said base being turned upwardly substantially 90° and a lower edge portion of said upstanding planar member being turned downwardly to engage therewith.

9. The clip connector according to claim 2, wherein said centering means comprises spaced dimples on said upstanding planar element on either side of said washer member.

10. The clip connector according to claim 2, wherein said centering means comprises a dimple on said upstanding planar element and an associated notch in said stiffening flange on said first portion of said washer member.

11. The clip connector according to claim 2, wherein said centering means is disengaged when said through fastener is tightened and said washer member is secured to an underlying support member.

12. The clip connector according to claim 1, wherein said first and second portions of said washer member are integral and the free ends thereof are provided with upstanding portions to prevent clip connector pull-out during uplift.

13. The clip connector according to claim 1, including spaced apertures and downwardly projecting dimples on said upper portion to facilitate flow of sealant.

* * * * *